United States Patent [19]

Rucci

[11] 4,141,462

[45] Feb. 27, 1979

[54] DEVICE FOR DECREASING HEAT TRANSFER AND SLOSH FROM A BEVERAGE CONTAINER

[76] Inventor: Charles D. Rucci, 315 Glen Ave., Port Chester, N.Y. 10573

[21] Appl. No.: 848,826

[22] Filed: Nov. 7, 1977

[51] Int. Cl.[2] ..... A47G 19/22; B65D 7/44; B65D 51/16

[52] U.S. Cl. ..... 220/254; 220/72; 220/90.4; 220/367; 229/7 R

[58] Field of Search ..... 220/90.2, 367, 90.4, 220/90.6, 269, 270, 306, 72, 254; 229/7 R; 206/508; 222/541

[56] References Cited

U.S. PATENT DOCUMENTS

| | | | |
|---|---|---|---|
| 2,560,376 | 7/1951 | Waterman | 229/7 R |
| 2,689,664 | 9/1954 | Vingron | 229/7 R |
| 2,696,943 | 12/1954 | Stevens | 229/7 R |
| 3,048,317 | 8/1962 | Cochrane et al. | 220/306 |
| 3,312,368 | 4/1967 | Reynolds et al. | 220/367 |
| 3,362,607 | 1/1968 | Weitzner | 229/7.5 |
| 3,421,681 | 1/1969 | Frank | 229/43 |
| 3,557,995 | 1/1971 | Hall | 206/508 |
| 3,800,999 | 4/1974 | Serritella | 220/90.4 |
| 3,806,023 | 4/1974 | Barnett | 229/43 |
| 3,843,016 | 10/1974 | Bornhorst et al. | 220/367 |
| 3,915,296 | 10/1975 | Spencer | 220/90.2 |
| 3,915,331 | 10/1975 | Chenault | 220/90.4 |
| 3,938,695 | 2/1976 | Ruff | 220/90.4 |
| 3,972,443 | 8/1976 | Albert | 220/90.4 |
| 3,977,559 | 8/1976 | Lombardi | 220/90.4 |
| 3,977,562 | 8/1976 | Wedzik | 229/7 R |
| 3,983,690 | 2/1976 | Butler | 220/90.4 |
| 3,994,411 | 11/1976 | Elfelt et al. | 220/90.4 |

*Primary Examiner*—William Price
*Assistant Examiner*—Allan N. Shoap
*Attorney, Agent, or Firm*—St. Onge, Steward, Johnston, Reens & Noe

[57] ABSTRACT

A device for decreasing heat transfer and slosh from a beverage container, such as a drinking cup, glass, mug or the like, that has an open end from which a beverage may be drunk, comprises a cover for the open end of the container, formed with an opening substantially smaller than the open end of the container and shaped and sized to be received by the mouth of the beverage drinker. The cover is equipped with a rim structure for securing it to the open end of the container and further has a web recessed from the rim. A portion of the perimeter of the drinking opening is adjacent the rim and the remainder of the perimeter is at the same level as the rim. A transition section joins the remainder of the drinking opening perimeter and web in a smoothly sloping manner. Accordingly, the cover decreases heat transfer from the contents of the container. The smoothly sloping transition section from the recessed web to the perimeter of the drinking opening insures that the contents of the container do not slosh toward the drinker when used.

8 Claims, 3 Drawing Figures

Fig. 1.
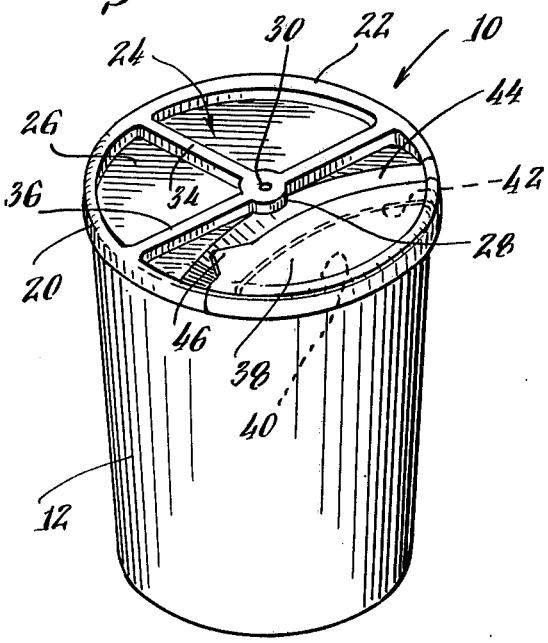
Fig. 2.
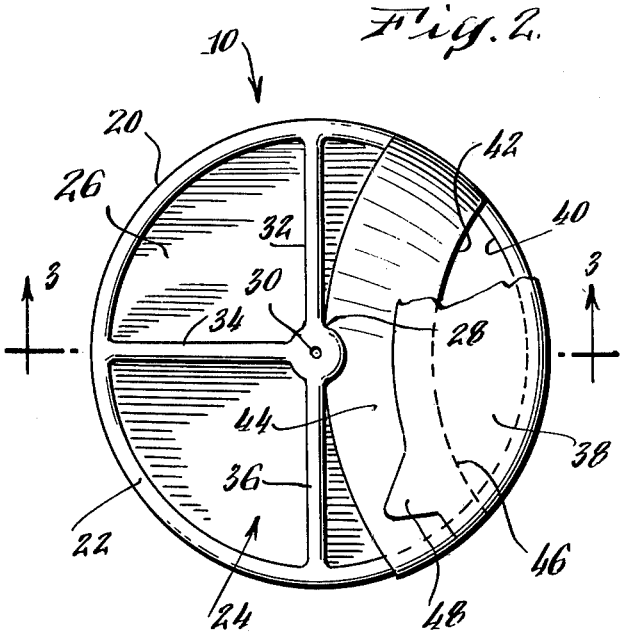
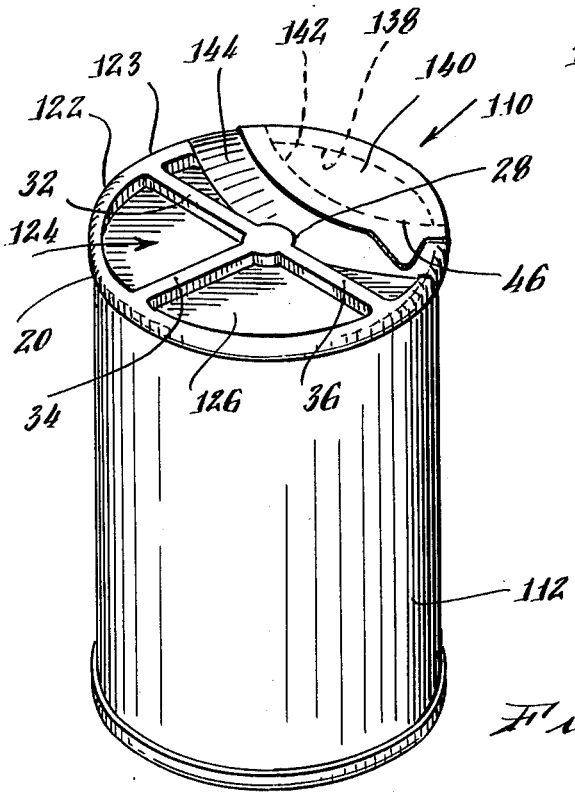
Fig. 4.
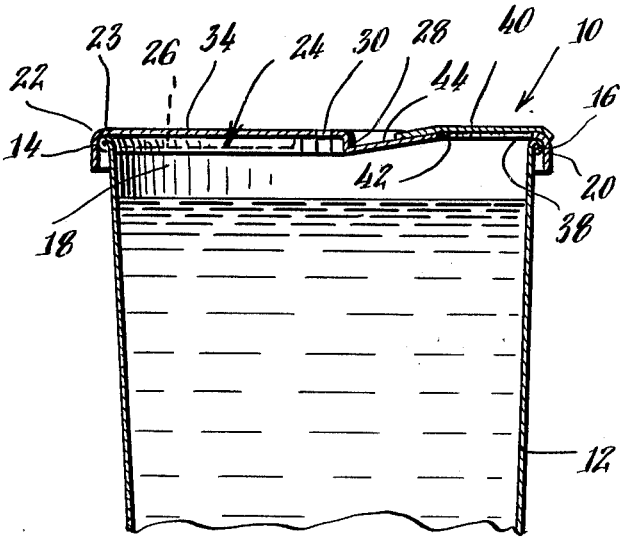
Fig. 3.

DEVICE FOR DECREASING HEAT TRANSFER AND SLOSH FROM A BEVERAGE CONTAINER

BACKGROUND OF THE INVENTION

1. Field of the Invention

The present invention relates to a device for decreasing heat transfer and slosh from a beverage container, such as a coffee cup, drinking glass, mug or the like.

Most beverages are meant to be drunk at temperatures which differ substantially from room temperature. For example, most people prefer to drink coffee substantially warmer than room temperature; similarly, most people prefer to drink milk and soft drinks substantially colder than room temperature. In both cases, if the beverage is allowed to stand for a significant period after its preparation, heat transfer will occur causing hot beverages to lose heat and cold beverages to gain it. Accordingly, such beverages no longer are as enjoyable for the consumer.

It is also common to drink many beverages while "on the go". For example, coffee and tea are often drunk in offices, factories, and other commercial establishments. The beverage drinker in these environments is likely to carry his container from place to place before all of the beverage is consumed. Therefore, spilling and slosh from the beverage container is often a problem.

The device of the present invention is intended to correct these difficulties encountered in the past.

DESCRIPTION OF THE PRIOR ART

Various attempts have been made in the past to solve the problem of maintaining a beverage at its desired temperature and of preventing slosh of the beverage when carried about by the consumer. For example, U.S. Pat. No. 3,800,999 (Serritella) discloses a non-spillable cup lid which has a frangible portion to form a drinking access opening. U.S. Pat. No. 3,983,690 (Butler) discloses a spill-proof drinking container which includes a cover having a slidable closure for a drinking opening. U.S. Pat. Nos. 3,977,559 (Lombardi) and 3,994,411 (Elfelt et al.) disclose container lids with foldback drink covers for openings.

Still other container closures are disclosed in U.S. Pat. Nos. 3,983,695 (Ruff); 3,915,331 (Chenault) and 3,421,681 (Frank), and a drinking container assembly is disclosed in U.S. Pat. No. 3,972,443 (Albert).

The devices disclosed in the patents noted above suffer from certain drawbacks. For example, the Serritella, Lombardi, Elfelt et al., and Ruff Patents all comprise recessed web cover portions which adjoin drinking openings. These recessed portions prevent the consumer's mouth from fitting tightly against the device cover and, therefore, do not adequately prevent spill and slosh during drinking. The Butler and Albert Patents disclose relatively complicated devices which are not desirable from a commercial point of view.

The device of the present invention is intended to correct these defficiencies.

SUMMARY OF THE INVENTION

In a preferred embodiment, to be described below in detail, the device of the present invention decreases heat transfer from the contents of the beverage container, be they hot or cold. Further, the device minimizes spillage during transport of the container from one place to another and minimizes slosh when a consumer drinks a beverage from the container. These objectives are achieved with a simple construction that may be economically produced and distributed in large numbers for disposable use. However, the structure of the device of the invention may also be economically incorporated into an integral beverage container such as a can.

In its preferred embodiment, the device of the present invention, which decreases heat transfer and slosh from a beverage container such as a drinking cup, glass, mug or the like, comprises a retaining lip or rim which secures the device to the mouth of the container. A cover is formed with the retaining lip and defines a web, which is recessed from the lip, and a drinking opening, which is substantially smaller than the open end of the container. The drinking opening has a portion of its perimeter adjacent to and joined to the lip. The remainder of the drinking opening perimeter is at the same level as the lip and the opening is shaped and sized to be received by the mouth of the beverage drinker. A transition section smoothly interconnects the perimeter of the drinking opening with the recessed portion of the web. Accordingly, when the consumer drinks from the container, he merely puts his mouth over the cover opening. Slosh is prevented by the transition section of the cover which smoothly guides liquid to the opening and minimizes turbulence that ordinarily occurs on the liquid surface.

A removable cover may be adhered to the device to cover the drinking opening before the beverage is to be consumed.

Accordingly, the large web and transition portions of the cover limit heat transfer from the contents of the container. Similarly, the drinking opening, which is specifically shaped to be received by the drinker's mouth, and the smoothly sloping transition portion minimize sloshing and spilling of the beverage in the container during transport and drinking.

Therefore, it is an object of the present invention to provide a device which limits spillage and sloshing of the beverage contained in, for example, a mug or a glass. It is a further object of the invention to limit heat transfer from those contents.

Other objects, aspects and advantages of the present invention will be pointed out or will be understood from the following detailed description provided below in conjunction with the accompanying drawings.

BREIF DESCRIPTION OF THE DRAWINGS

FIG. 1 is a perspective view of a container with the device of the present invention installed on its open end.

FIG. 2 is a top plan view of the device of the present invention.

FIG. 3 is a vertical cross-sectional view of the device and container taken through Plane 3—3 in FIG. 2.

FIG. 4 is a perspective view similar to FIG. 1 of the present invention, embodied in an integral form with a container.

DETAILED DESCRIPTION OF PREFERRED EMBODIMENTS

FIG. 1 illustrates the device of the present invention, generally indicated at 10, installed on a container, generally indicated at 12, in the form of, for example, a styrofoam or polystyrene disposable drinking cup. The container 12 is of the type usually used in connection with drink dispensing machines such as a coffee machine or used at take-out restaurants, such as fast-food establishments. The cup is formed with an upper rim 14 which may or may not have an enlarged lip 16. The lip encircles an open end 18 of the container.

The device 10 of the present invention, which covers the open end 18 of the container 12, is desirably made of a light-weight inexpensive thin-walled material. It is most easily formed by a molding or forming operation from a flat sheet of material. Many materials, such as metal foil, wax or resin-impregnated paper are satisfactory. However, thermoplastic or synthetic plastic is preferred. The device may be formed to have features, which will be described in greater detail below, by a thermoforming operation which is believed to be the most economical. As used in this Specification and Concluding Claims, the term "thermoforming" includes methods of forming articles from a thermoplastic sheet such as vacuum forming and forming between pairs of mating die numbers. Typically, the sheet is either heated prior to or during the forming operation. Typical thermoplastic materials which are suitable for making the device of the invention are polyvinyl chloride, polyvinyl acetate, polyethylene, polymylene, high impact polystyrene, polycarbonates, and acrylonitrile-butadiene-styrene-copolymer.

The thermoplastic sheet material may have a thickness of 0.010 inch yet may vary within limits employed in the thermoplastic forming art.

As shown in FIG. 2, the device of the present invention is formed as described above to cover the open end 18 of the container. The device includes an annular rim or lip 20 that defines an annular channel 22 formed to grippingly engage the container rim 14. The lip defines an upper extreme 23 of the device. The area enclosed by the lip defines a cover 24 for sealing the open end of the container and includes a recessed portion 26 which is countersunk from the extreme 23 of the lip (FIG. 3). The recessed portion 26 is further formed with a central, upwardly projecting button 28 having a small pressure-venting hole 30 in its center. Extending radially from the button 28 are three ribs 32, 34 and 36. These ribs align the devices of the invention for stacking during storage and transportation, as will be described in greater detail below.

The cover for the present invention is further formed with a crescent-sided drinking opening 38 having at least a portion 40 of its periphery adjacent the edge of the annular rim 22. As can be seen in FIGS. 2 and 3, the recessed cover portion 26 and the remaining periphery 42 of the drinking opening are joined by an arcuate transition portion 44 which smoothly slopes from the recessed portion to the periphery 42. Accordingly, the entire drinking opening periphery 40, 42, is positioned at a level substantially coextensive with the plane defined by the upper extremity 23 of the annular rib 22. Further, the drinking opening being crescent-sided, is ideal for being received by the drinker's mouth. Thus, it can be appreciated, that the drinker's lips will fit tightly about the drinking opening on the transition portion 44 of the cover or the container positioned immediately below it.

The device of the invention may also include a removable cover panel 46 for covering the drinking opening 40 prior to the time when the beverage in the container is to be consumed. This drinking opening cover is preferably sealed about the periphery 40, 42 of the drinking opening, with any suitable adhesive that is largely unaffected by the beverage contents at the desired temperatures. Further, a non-adhesive tab 48 is provided for removing the cover 46. It will be appreciated that the drinking opening is substantially smaller than the open end of the container. Thus, even after removal of the opening cover 46, heat transfer from the contents of the container is limited by the large cover section 44 of the device. Further, it can be appreciated that the smoothly sloping transition section 44 between the recessed cover portion 26 and the periphery 42 of the drinking opening 38 minimizes slosh by smoothly guiding the beverage to the periphery 42 and hence to the drinker's mouth.

The smoothly sloping section and drinking opening are believed not to be sufficient to permit optimum stacking of the device of the present invention in and of themselves. Accordingly, the ribs 32, 34, 36 are provided to properly align the device with other similar devices for optimum utilization of space during stacking for storage. The configuration of ribs is such that the device can only be properly stacked in one attitude.

It will also be appreciated, that other means of closing the drinking opening, for example a frangible cover section may be provided to be broken out when it is desired to drink the contents of the container.

The device of the invention may be embodied in other forms. For example, as illustrated in FIG. 4, it 110 may be formed integrally with a container 112 such as a metal can for soft drinks. The upper extreme of the container 123 then defines a lip 122 which partially forms the perimeter 138 of a drinking opening 140. The upper section of the container further has a recessed web portion 126 and a transition section 144 which smoothly leads to the remainder 142 of the perimeter of the drinking opening 138. The cover 146 for the drinking opening may, again, be desirably a frangible or tearable portion which is removable when the contents of the container are to be consumed. While the device is illustrated in this embodiment with ribs 132, 134 and 136, they may be omitted.

Further, when the device is integrally formed with a container for, for example, carbonated soft drinks, the vent hole is omitted. While being described as a disposable container lid, the device of the present invention may be embodied in a more substantial reusable form for installation on coffee cups, or glasses, as examples. In such cases blow molding or injection molding techniques may be employed to form materials having greater thickness than the thermal plastic materials described above. Further, the device may be formed, rather than from a sheet of material, from thermoplastic beads using conventional injection or open molding techniques.

Further, other means of closing the drinking opening may be provided. For example, a slidable cover similar to that disclosed in U.S. Pat. No. 3,938,690 (Butler) may be used. The cover may slide radially toward the center of the main cover portion 26 or may slide circumferentially away from the drinking opening.

Accordingly, the present invention achieves substantial advantages over the prior art in relatively simple yet elegant fashion.

Although specific embodiments of the invention have been described above in detail, it is to be understood that this is for purposes of illustration. Modifications may be made to the described device for preventing heat transfer and slosh from a beverage container in order to adapt the device to particular applications.

I claim:

1. A device for decreasing heat transfer from the contents of a beverage container, such as a drinking cup, glass, mug or the like, that has an open end from which the beverage may be drunk, said device comprising:

A. means for securing the device to the container and having a lip at an extreme of said device that defines a plane; and B. a cover formed with said securing means defining a drinking opening, substantially smaller than the open end of the container, having a first crescent-sided portion of its perimeter adjacent said lip, and a second crescent-sided remainder portion of its perimeter curved away from said first portion, said drinking opening thereby having a shape and size to be received by the mouth of the beverage drinker; both said first and second portions of the perimeter of said drinking opening lying substantially in the plane defined by said lip; said cover further having 1. a web inwardly and downwardly recessed from said lip; and
2. a transition section joining said second portion of said drinking opening perimeter and said web, sloping continuously and smoothly therebetween to smoothly guide the beverage to the drinking opening and the drinker's mouth.

2. The device for decreasing heat transfer from the contents of a beverage container as claimed in claim 1 wherein said container has a rim about the perimeter of the open end and wherein said securing means comprises:

an annular channel shaped to grippingly engage the rim of said container.

3. The device for decreasing heat transfer from the contents of a beverage container as claimed in claim 1, wherein said securing means comprises permanent attachment means for securing said cover to the container.

4. The device for decreasing heat transfer from the contents of a beverage container as claimed in claim 3, wherein said permanent attachment means comprises:

an integral formation of said cover with said container.

5. The device for decreasing heat transfer from the contents of a beverage container as claimed in claim 1, further comprising removable closure means for closing said drinking opening.

6. The device for decreasing heat transfer from the contents of a beverage container as claimed in claim 1 wherein said transition section is arcuate.

7. The device for decreasing heat transfer from the contents of a beverage container as claimed in claim 1 wherein said cover further has a plurality of stiffening ribs.

8. The device for decreasing heat transfer from the contents of a beverage container as claimed in claim 1 wherein said cover further defines a pressure-venting hole.

* * * * *